US006851229B2

(12) United States Patent
Inzeo

(10) Patent No.: US 6,851,229 B2
(45) Date of Patent: Feb. 8, 2005

(54) ANCHOR BAR SPLICE

(75) Inventor: Joe A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 130 days.

(21) Appl. No.: 09/951,617

(22) Filed: Sep. 14, 2001

(65) Prior Publication Data

US 2003/0051416 A1 Mar. 20, 2003

(51) Int. Cl.[7] ..... E04D 13/14

(52) U.S. Cl. ..... 52/96; 52/60; 52/97; 52/300; 52/309.4; 428/71

(58) Field of Search ..... 52/94–97, 58, 52/60, 300, 309.4, 309.9, 309.15, 407.1, 716.1, 716.2, 582.1, 586.1, 520, 726.1, 309.8, 309.14, 404.3, 406.1, 406.2, 406.3, 407.2, 407.3, 407.21; 428/71, 76

(56) References Cited

U.S. PATENT DOCUMENTS

| | | | | | |
|---|---|---|---|---|---|
| 2,927,626 | A | * | 3/1960 | Corwin et al. | 428/71 |
| 3,230,681 | A | * | 1/1966 | Allen et al. | 428/71 |
| 3,518,786 | A | * | 7/1970 | Holtvoigt | 428/71 |
| 3,802,140 | A | * | 4/1974 | Hickman | 52/300 |
| 3,987,134 | A | * | 10/1976 | Shiina et al. | 264/45 |
| 4,071,987 | A | * | 2/1978 | Hickman | 52/94 |
| 4,213,279 | A | * | 7/1980 | Layne | 52/173.2 |
| 4,328,273 | A | * | 5/1982 | Yackiw | 428/71 |
| 4,356,676 | A | * | 11/1982 | Hauptman | 428/71 |
| 4,665,667 | A | | 5/1987 | Taylor et al. | |
| 4,795,666 | A | * | 1/1989 | Okada et al. | 428/71 |
| 4,931,339 | A | * | 6/1990 | Malcolm-Brown | 428/71 |
| 4,969,250 | A | * | 11/1990 | Hickman et al. | 29/521 |
| 4,985,106 | A | * | 1/1991 | Nelson | 428/71 |
| 5,289,662 | A | * | 3/1994 | Castle | 52/287.1 |
| 5,337,526 | A | * | 8/1994 | Hartman | 52/58 |
| 5,360,653 | A | * | 11/1994 | Ackley | 428/71 |
| 5,564,249 | A | * | 10/1996 | Borys et al. | 52/716.5 |
| 5,571,581 | A | * | 11/1996 | Koizumi et al. | 428/31 |
| 6,110,312 | A | * | 8/2000 | Arnold et al. | 156/204 |
| 6,110,546 | A | * | 8/2000 | Honda et al. | 428/31 |
| 6,216,408 | B1 | * | 4/2001 | Davidson | 52/300 |
| 6,298,191 | B1 | * | 10/2001 | Daoud | 385/137 |
| 6,615,560 | B2 | * | 9/2003 | Ito | 52/506.06 |

FOREIGN PATENT DOCUMENTS

| | | | | |
|---|---|---|---|---|
| AU | 228752 | * | 6/1960 | 428/71 |
| DE | 2003683 | * | 8/1971 | 428/71 |
| DE | 3005-015 | * | 8/1981 | 428/71 |
| FR | 2697276 | * | 4/1994 | 428/71 |
| GB | 2142287 | * | 1/1985 | 428/71 |

* cited by examiner

*Primary Examiner*—Winnie Yip
(74) *Attorney, Agent, or Firm*—Michael Best & Friedrich LLP

(57) ABSTRACT

The present invention is directed to a fascia assembly that includes a first anchor bar, a second anchor bar, and an anchor bar splice. The first and second anchor bars are mounted to a vertical surface of an edge of a roof. The first anchor bar includes a first end, and the second anchor bar includes a second end that is adjacent to the first end of the first anchor bar. The anchor bar splice is positioned between the first end of the first anchor bar and the second end of the second anchor bar for preventing the passage of water between the first and second anchor bars. The anchor bar splice includes a resilient shell that defines a cavity and a foam core within the cavity.

17 Claims, 3 Drawing Sheets

ANCHOR BAR SPLICE

FIELD OF THE INVENTION

The invention relates to fascia assemblies, and more particularly to fascia assemblies that include anchor bar splices.

BACKGROUND OF THE INVENTION

Large rubber membranes are commonly used for covering and protecting a roof such as a flat roof. Some membranes are laid over the surface of the roof and secured in place by fascia assemblies that rigidly secure the edge of the membrane to the edge of the roof. The fascia assemblies prevent the membrane from being pulled away from the edge of the roof by large wind forces and also allow for the mounting of decorative covers.

Fascia assemblies include anchor bars that are mounted consecutively to the edge of the roof in an end to end relationship to completely cover the edge of the roof. Typically, the anchor bars include upwardly extending flanges. The upwardly extending flanges prevent rainwater that accumulates on the membrane from flowing over the anchor bars and onto the ground below. Anchor bar splices are generally positioned between adjacent ends of consecutive anchor bars to prevent the flow of rainwater between consecutive anchor bars.

Some anchor bar splices include a sheet metal or aluminum angled portion and a foam spacer portion that is glued to the metal angled portion. The angled portion is coupled between the roof and consecutive anchor bars and the foam spacer is compressed between adjacent ends of consecutive anchor bars.

SUMMARY OF THE INVENTION

The present invention is directed to a fascia assembly that includes an anchor bar splice that improves the seal between adjacent ends of consecutive anchor bars by providing a spacer that includes a water-resistant resilient shell and a resilient compressible foam within the shell. The present invention also simplifies the manufacture of the anchor bar splice by providing an anchor bar splice that is capable of being injection molded. The present invention also increases the service life of the anchor bar splice by integrally forming an angle portion with the spacer to eliminate the use of adhesives that typically degrade when subjected to normal weather conditions.

One embodiment of the present invention is directed to a fascia assembly for engaging the upper portion of a roof. The roof includes an upper surface and an elongated edge that defines a generally vertical surface. The fascia assembly includes a first anchor bar, a second anchor bar, and an anchor bar splice. The first and second anchor bars are mounted to the vertical surface of the edge of the roof. The first anchor bar includes a first end, and the second anchor bar includes a second end that is adjacent to the first end of the first anchor bar. The anchor bar splice is positioned between the first end of the first anchor bar and the second end of the second anchor bar for preventing the passage of water between the first and second anchor bars. The anchor bar splice includes a resilient shell that defines a cavity and a foam core within the cavity.

Another embodiment of the present invention is directed to an anchor bar splice for use in a fascia assembly that engages the upper portion of the roof. The anchor bar splice includes a resilient shell that defines a cavity and a foam core within the cavity.

Other features and advantages of the invention will become apparent to those skilled in the art upon review of the following detailed description, claims, and drawings.

Figure 1:
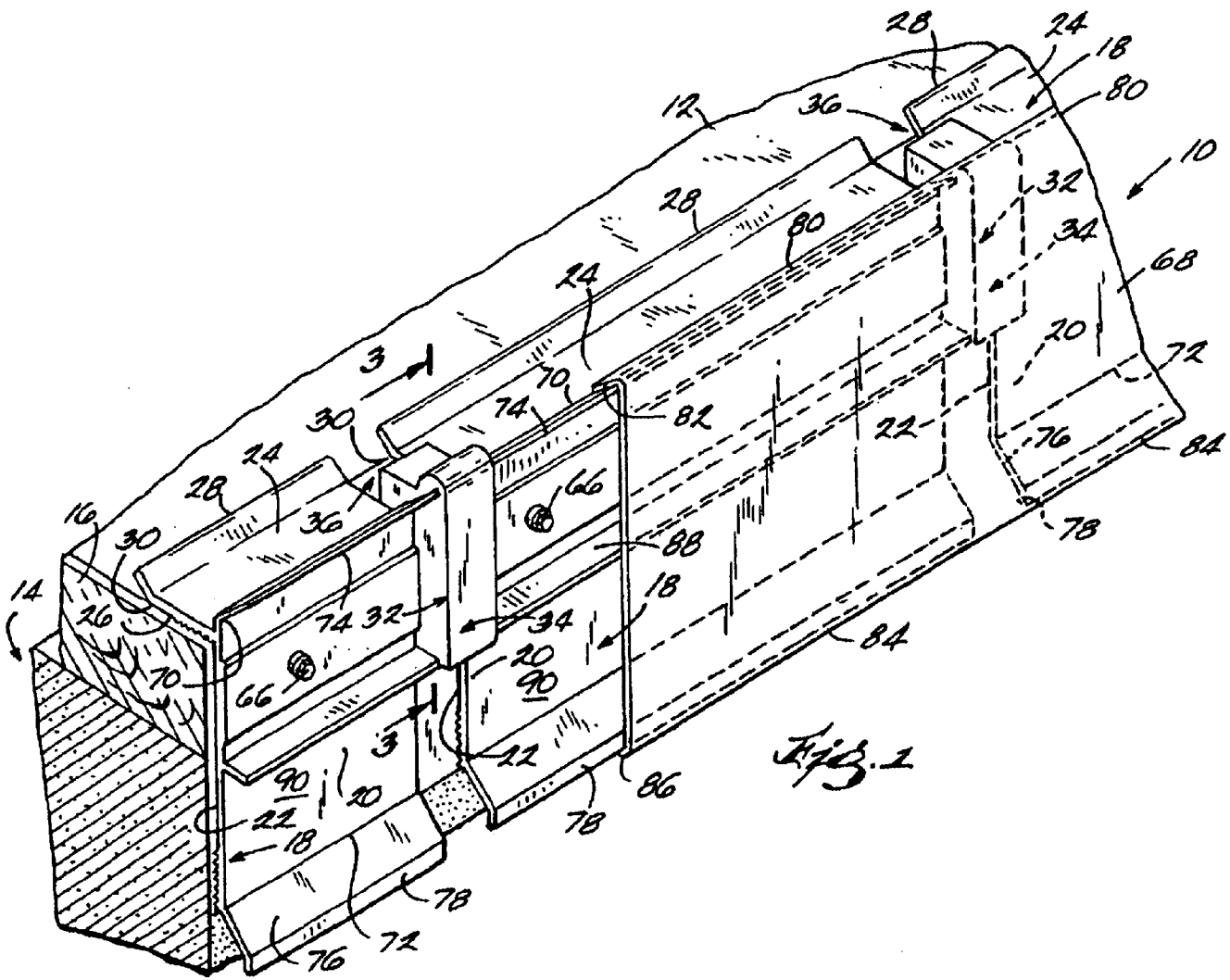
FIG. 1 is a perspective view of a fascia assembly including an anchor bar splice embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Illustrated in FIG. 1 is a fascia assembly 10 that secures the edge of a rubber membrane 12 to the surface of a flat roof 14. The rubber membrane 12 is supported by the flat generally horizontal upper surface of the roof 14, and the edge of the membrane 12 extends over the vertical face of a conventional wooden nailer 16 such that the extending portion of the membrane 12 can be secured against the vertical face of the nailer 16.

Figure 2:
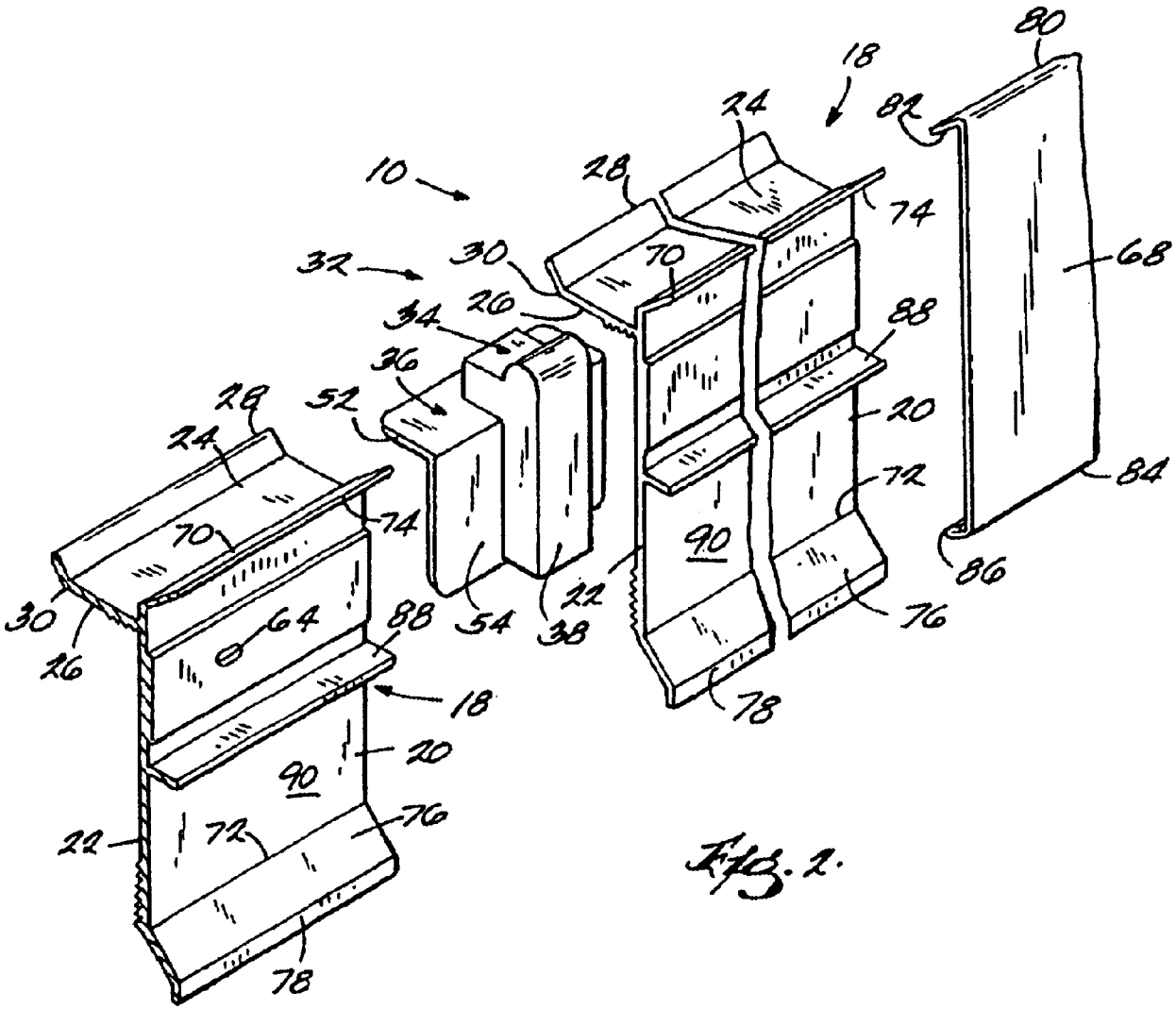
FIG. 2 is an exploded view of the fascia assembly shown in FIG. 1.

Referring also to FIG. 2, the fascia assembly 10 includes elongated anchor bars 18 that are positioned in an end to end relationship along the edge of the roof 14. The anchor bars 18 secure the rubber membrane 12 to the nailer 16 to thereby prevent the edge of the rubber membrane 12 from pulling upwardly away from the edge of the roof 14. Each anchor bar 18 includes a rigid plate 20 that has a generally planar rearward surface 22 adapted to engage that portion of the rubber membrane 12 folded over the edge of the roof 14. The rigid plate 20 also clamps that portion of the membrane 12 securely against the vertical face or surface of the nailer 16. In the illustrated arrangement, a portion of the vertical plate 20 extends above the surface of the roof 14, and the remainder of the vertical plate 20 engages the vertical face of the nailer 16 forming the edge of the roof 14.

The anchor bar 18 also includes a flange 24 projecting from the rearward surface 22 of the vertical plate 20. The rearwardly extending flange 24 includes a lower surface 26 that is adapted to engage the rubber membrane 12 and secure it downwardly against the upper surface of the nailer 16 such that the rubber membrane 12 cannot be pulled away from the surface of the roof 14 or away from the edge of the roof 14.

In a preferred form of the invention the flange 24 and the plate portion 20 of the anchor bar 18 are rigid and integrally joined. This construction can be achieved by producing the anchor bar 18 as an elongated extrusion of material such as aluminum. The aluminum extrusion will produce a rigid structure wherein the flange 24 and plate 20 are substantially inflexible with respect to one another such that the projecting end of the flange 24 cannot be pulled upwardly away from the surface of the roof 14 in response to an upward force by the membrane 12 against the flange 24.

In a preferred form of the invention the rearwardly extending flange 24 will also include an edge portion 28 extending along its length, the edge portion 28 being inclined upwardly. The inclined edge portion 28 of the flange 24 is joined to the flange 24 by a curved lower surface 30 such that the surface of the flange 24 that engages the rubber membrane 12 does not include sharp corners which might pierce the membrane 12. The inclined edge portion 28 of the flange 24 prevents rainwater that accumulates on the membrane 12 from flowing over the anchor bar 18 and onto the ground below the roof 14.

The fascia assembly 10 also includes anchor bar splices 32 that are positioned between one end of a first anchor bar 18 and an adjacent end of a second adjacent anchor bar 18. The anchor bar splices 32 prevent water that accumulates on the membrane 12 from flowing between adjacent anchor bars 18 and down to the ground below the roof 14. Each anchor bar splice 32 includes a spacer 34 connected to an angled portion 36.

Figure 3:
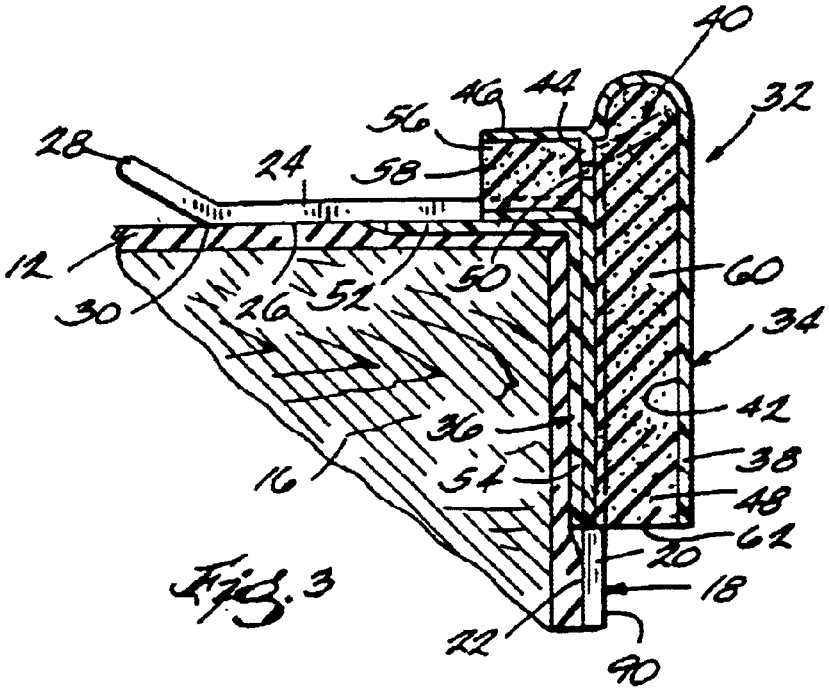
FIG. 3 is a cross-section view of the anchor bar splice taken along line 3—3 in FIG. 1.
Figure 4:
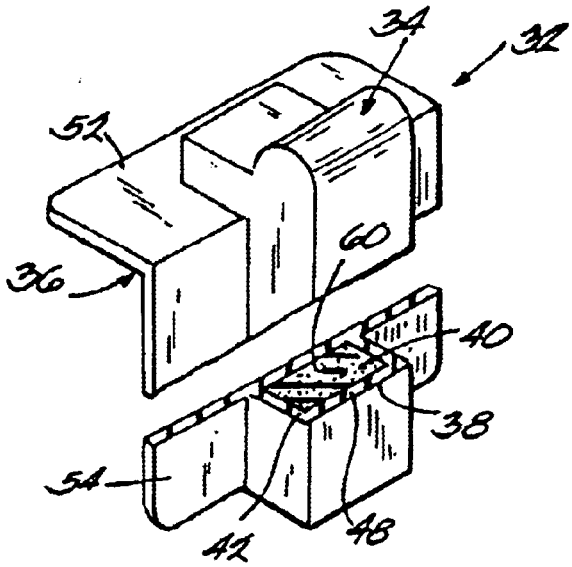
FIG. 4 is a partial cutaway view of the anchor bar splice shown in FIG. 1.

The spacer 34 is compressed between the adjacent ends of the adjacent anchor bars 18 to seal the gap between the adjacent anchor bars 18. As best shown in FIGS. 3 and 4, the spacer 34 includes a resilient shell 38 and a foam core 40. The foam core 40 is positioned within a cavity 42 that is defined by the shell 38. The shell 38 is made from EPDM rubber and the foam core 40 is made of EPDM foam. EPDM, commonly known as ethylene propylene di-methane, is water and chemical resistant and also resists aging caused by weather and the presence of ozone. The shell 38 includes a wall 44 that divides the cavity into first and second sections 46, 48. The wall 44 includes a hole 50 that is in communication with the first and second sections 46, 48. The physical characteristics of the foam core 40 allow the spacer 34 to be compressed between adjacent anchor bars 18 and the physical characteristics of the shell 38 provide a water resistant seal against each of the adjacent anchor bars 18.

The angled portion 36 of the anchor bar splice 32 includes an upper flange 52 and a lower flange 54 that extends perpendicularly from the upper flange 52. The upper flange 52 is pressed between the lower surface 26 of the rearwardly extending flange 24 of the anchor bar 18 and the upper surface of the membrane 12, and the lower flange 54 is pressed between the rearward surface 22 of the vertical plate 20 of the anchor bar 18 and the vertical face of the nailer 16 in order to fix the position of the anchor bar splice 32 between adjacent anchor bars 18.

The anchor bar splice 32 is formed by injection molding such that the shell 38 and the angled portion 36 are integrally formed with each other. Once the shell 38 is formed, a first portion 56 of the foam core 40 is inserted through a first opening 58 and mounted in the first section 46 of the cavity 42 and a second portion 60 of the foam core 40 is inserted through a second opening 62 and mounted in the second section 48 of the cavity 42. In the illustrated embodiment, the first and second portions 56, 60 of the foam core 40 are glued to the shell 38 in the respective sections 46, 48 of the cavity 42.

Referring again to FIGS. 1 and 2, a plurality of apertures 64 are provided through the vertical plate portion 20. The apertures 64 are spaced apart along the length of the anchor bar 18, and screws 66 can extend through the apertures 64 to rigidly secure the anchor bar 18 to the wooden nailer 16 forming the edge portion of the roof 14.

When the anchor bars 18 are in place, as illustrated in FIG. 1, the lower surfaces 26 of the rearwardly extending flanges 24 clamp the edge of the rubber membrane 12 downwardly against the upper surface of the wooden nailer 16, and the rearward faces 22 of the vertical plate portions 20 of the anchor bars 18 similarly clamp the downwardly extending edge of the rubber membrane 12 firmly against the vertical planar face of the wooden nailer 16. The fascia assembly 10 thus provides a very rigid and secure mechanism for clamping the edge of the rubber membrane 12 against the surface of the roof 14 and secures the rubber membrane 12 in place and is resistant to even large upward forces on the membrane 12 which might be caused by high winds.

The fascia assembly 10 also includes cover plates 68 which are positioned over the anchor bars 18 to provide a decorative cover for the anchor bars 18 and the screws 66 used to secure the anchor bars 18 to the edge of the roof 14. In the illustrated arrangement, the anchor bar 18 includes upper and lower edges 70, 72. The upper edge 70 includes a flange portion 74 inclined upwardly and forwardly. The lower elongated edge 72 of the anchor bar 18 similarly includes a second flange portion 76 which is inclined downwardly and forwardly and which terminates in a downwardly extending lip 78. Each cover plate 68 includes an upper edge 80 that defines a lip 82 adapted to hook over the flange portion 74 of the anchor bar 18 to engage the flange portion 74. A lower edge 84 of the cover plate 68 includes a resilient lip 86 adapted to be resiliently forced over the lip 78 of the lower flange portion 76. Once the lip 82 has been hooked over the edge 70 of the upper flange 74, the lower lip 86 of the cover plate 68 can be forced over the lip 78 of the lower flange portion 76 and will resiliently hold the cover plate 68.

In the illustrated construction, the anchor bar 18 also includes a rib 88 extending forwardly from a forward face 90 of the plate 20. The rib 88 functions to support the cover plate 68 and to provide increased rigidity to the anchor bar 18.

We claim:

1. A fascia assembly for engaging the upper portion of a roof, the roof having an upper surface and an elongated edge, the edge of the roof defining a generally horizontal surface and a generally vertical surface, the fascia assembly comprising:

a first anchor bar including a vertically-oriented plate adapted to engage with the vertical surface of the edge of the roof, the plate having an upper portion and a lower portion, a horizontally-oriented flange extending from the upper portion of the plate and adapted to engage with the horizontal surface of the edge of the roof, and a first end;

a second anchor bar including a vertically-oriented plate adapted to engage with the vertical surface of the edge of the roof, the plate of the second anchor bar including an upper portion and a lower portion, a horizontally-oriented flange extending from the upper portion of the plate of the second anchor bar and adapted to engage with the horizontal surface of the edge of the roof, and a second end adjacent to the first end of the first anchor bar; and an anchor bar splice positioned between and engaged with the first end and the second end for preventing the passage of water between the first and second anchor bars, the anchor bar splice including a resilient shell defining a cavity, and a foam core within the cavity.

2. The fascia assembly of claim 1, wherein the anchor bar splice includes an angle portion having an upper flange adapted to be coupled between the upper surface of the roof and the flanges of the first and second anchor bars and a lower flange adapted to be coupled between the vertical surface of the roof and the plates of the first and second anchor bars.

3. The fascia assembly of claim 2, wherein the shell is integrally formed with the angle portion.

4. The fascia assembly of claim 1, wherein the shell is made of EPDM rubber, and the foam core is made of EPDM foam.

5. The fascia assembly of claim 1, wherein the shell includes a wall that divides the cavity into first and second sections.

6. The fascia assembly of claim 5, wherein the shell includes a first opening that is in communication with the first section of the cavity and a second opening that is in communication with the second section of the cavity.

7. The fascia assembly of claim 6, wherein the core includes a first portion that is mounted within the first section of the cavity and a second portion that is mounted within the second section of the cavity.

8. The fascia assembly of claim 7, wherein the first and second portions of the core are mounted to the respective first and second sections of the cavity with adhesive.

9. The fascia assembly of claim 5, wherein the wall includes an aperture that is in communication with both the first and second sections of the cavity.

10. An anchor bar splice for use in a fascia assembly that is adapted to engage the upper portion of the roof, the roof having an upper surface and an elongated edge, the edge of the roof defining a generally horizontal surface and a generally vertical surface, the fascia assembly including a first anchor bar having a vertically-oriented plate adapted to engage with the vertical surface of the edge of the roof, the plate having an upper portion and a lower portion, a horizontally-oriented flange extending from the upper portion of the plate and adapted to engage with the horizontal surface of the edge of the roof, and a first end, and a second anchor bar having a vertically-oriented plate adapted to engage with the vertical surface of the edge of the roof, the plate of the second anchor bar having an upper portion and a lower portion, a horizontally-oriented flange extending from the upper portion of the plate of the second anchor bar and adapted to engage with the horizontal surface of the edge of the roof, and a second end adjacent to the first end of the first anchor bar, the anchor bar splice positionable between the first end and the second end for preventing the passage of water between the first and second anchor bars, the anchor bar splice comprising:

a resilient shell defining a cavity;

a foam core within the cavity; and an angle portion including upper and lower flanges connected to the shell, wherein the upper flange and the lower flange are substantially at right angles relative to each other for engaging the horizontal and vertical surfaces of the roof edge and for positioning between and engaging with the first and second ends of the first and second anchoring bars.

11. The anchor bar splice of claim 10, wherein the shell is integrally formed with the angle portion.

12. The anchor bar splice of claim 10, wherein the shell is made of EPDM rubber, and the foam core is made of EPDM foam.

13. The anchor bar splice of claim 10, wherein the shell includes a wall that divides the cavity into first and second sections.

14. The anchor bar splice of claim 13, wherein the shell includes a first opening that is in communication with the first section of the cavity and a second opening that is in communication with the second section of the cavity.

15. The anchor bar splice of claim 14, wherein the core includes a first portion that is mounted within the first section of the cavity and a second portion that is mounted within the second section of the cavity.

16. The anchor bar splice of claim 15, wherein the first and second portions of the core are mounted to the respective first and second sections of the cavity with adhesive.

17. The anchor bar splice of claim 13, wherein the wall includes an aperture that is in communication with both the first and second sections of the cavity.

* * * * *